US009376794B2

(12) United States Patent
Page et al.

(10) Patent No.: US 9,376,794 B2
(45) Date of Patent: Jun. 28, 2016

(54) TOILET BOWL DEODORIZER FIXTURE

(71) Applicants: James W. Page, Frederick, CO (US); Linda P. Page, Frederick, CO (US)

(72) Inventors: James W. Page, Frederick, CO (US); Linda P. Page, Frederick, CO (US)

( * ) Notice: Subject to any disclaimer, the term of this patent is extended or adjusted under 35 U.S.C. 154(b) by 0 days.

(21) Appl. No.: 14/489,988

(22) Filed: Sep. 18, 2014

(65) Prior Publication Data

US 2016/0024772 A1 Jan. 28, 2016

Related U.S. Application Data

(63) Continuation of application No. 14/339,773, filed on Jul. 24, 2014.

(51) Int. Cl.

| | |
|---|---|
| ***E03D 9/03*** | (2006.01) |
| ***A47K 17/00*** | (2006.01) |
| ***A47K 13/30*** | (2006.01) |
| *E03D 9/02* | (2006.01) |

(52) U.S. Cl.

CPC ..... *E03D 9/037* (2013.01); *A47K 13/30* (2013.01); *A47K 17/00* (2013.01); *E03D 9/032* (2013.01); *E03D 2009/028* (2013.01)

(58) Field of Classification Search

CPC ..... E03D 9/032; E03D 9/03; E03D 2009/026; E03D 2009/028

USPC ..... 4/231

See application file for complete search history.

(56) References Cited

U.S. PATENT DOCUMENTS

| | | | | | |
|---|---|---|---|---|---|
| 866,400 | A * | 9/1907 | Stevens | | 4/229 |
| 2,716,243 | A * | 8/1955 | Kimzey | | 4/222 |
| 2,760,209 | A * | 8/1956 | Ewing et al. | | 4/223 |
| 3,249,951 | A * | 5/1966 | Thompson | | 4/229 |
| 3,316,559 | A * | 5/1967 | Ewing | E03D 9/032 | 4/223 |
| 3,668,717 | A * | 6/1972 | Curran | | 4/231 |
| 4,670,916 | A * | 6/1987 | Bloom | | 4/231 |
| 5,457,822 | A * | 10/1995 | Klammsteiner | | 4/223 |
| 6,178,563 | B1 * | 1/2001 | Helfet | | 4/213 |
| 6,622,315 | B1 * | 9/2003 | Feygin et al. | | 4/223 |
| 6,691,328 | B2 * | 2/2004 | Delfino | | 4/227.1 |

* cited by examiner

*Primary Examiner* — Janie Loeppke

(74) *Attorney, Agent, or Firm* — Wessels & Arsenault L.L.C.; John Allan Arsenault; Daniel Dubuisson

(57) ABSTRACT

A simple and inexpensive plastic assembly snaps over the rim of a toilet bowl. The deodorizer/disinfecting embodiment container hangs outside the toilet bowl. It is supported by a rim clamp inside the toilet bowl. One model simply clips on clips off for disposable use. Other models have a container with a refillable top. An adjustable exit tube nut adjusts to various different toilet rims. When the user sits on the toilet seat, a diaphragm is compressed which forces air into the container and deodorant/disinfectant into the toilet bowl. The diaphragm needs to be made of neoprene or any flexible material with sufficient memory to return to its original non compressed shape after compression.

13 Claims, 5 Drawing Sheets

TOILET BOWL DEODORIZER FIXTURE

FIELD OF INVENTION

The present invention relates to using the downward force on a toilet seat to squeeze a diaphragm mounted on a simple clip on deodorizing/disinfecting assembly, thereby spraying a deodorant/disinfectant into the toilet bowl as the user sits down.

BACKGROUND OF INVENTION

Below follows a brief summary of related prior art. U.S. Pat. No. 866,400 (1907) to Stevens discloses a bellows under the front of a toilet seat so that a person sitting on the toilet seat compresses the bellows. A burst of air travels from the front to the rear of the toilet seat into a box which may hold a liquid deodorant. The air mixes with the liquid deodorant to discharge a spray into the bowl. Upon lifting the toilet seat air travels thru the box, again mixing with the deodorant and gets stored in the bellows. Thus, the air is mixed with the deodorant twice. The box can be refilled via its removable cover. This embodiment requires modification to the toilet.

U.S. Pat. No. 6,178,563 (2001) to Helfet discloses a toilet seat with a compression cylinder under it. Sitting on the toilet seat moves an inner cylinder to cause a liquid to be discharged into the bowl.

U.S. Pat. No. 6,622,315 (2003) to Feygin et al. discloses a bellows under a toilet seat which dispenses a liquid. The discharge occurs when the user stands.

U.S. Pat. No. 3,249,951 (1966) L. J. Thompson discloses a custom toilet seat encompassing the Stevens idea.

What is needed in the art is a disposable or refillable clip on fixture for a standard toilet and seat that dispenses a deodorant/disinfectant when the user sits down.

It does not require modification to the toilet. The present invention hangs off the edge of the toilet seat rim. A plastic one piece construction provides an inexpensive disposable model. Other refillable models are also disclosed.

SUMMARY OF THE INVENTION

The main aspect of the present invention is to provide a plastic fixture over a toilet bowl rim, wherein the fixture includes a deodorant/disinfectant container and a diaphragm which acts to spray the deodorant/disinfectant into the toilet bowl when the user sits on the toilet bowl seat.

Another aspect of the present invention is to provide a fully disposable embodiment.

Another aspect of the present invention is to provide a refillable embodiment.

Another aspect of the present invention is to provide an adjustable rim height attachment.

Other aspects of this invention will appear from the following description and appended claims, reference being made to the accompanying drawings forming a part of this specification wherein like reference characters designate corresponding parts in the several views.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE DRAWINGS

Figure 1:
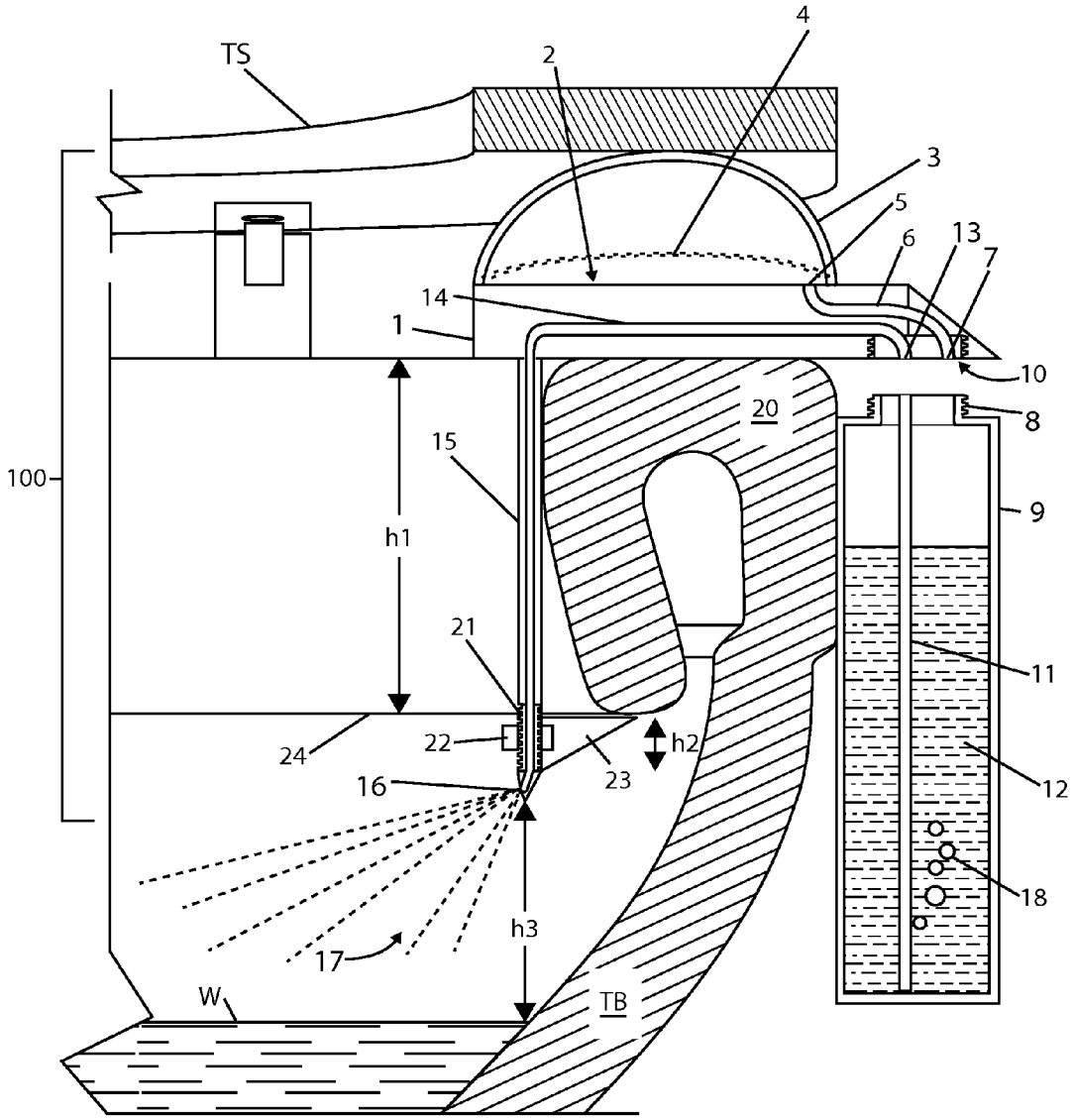
FIG. 1 is a front elevation view of a mounted, refillable deodorizer/disinfecting embodiment.

Referring first to FIG. 1 the deodorizer/disinfecting embodiment 100 has an upper body 1 with a top surface 2. A diaphragm 3 is glued to the top surface 2. The toilet seat TS compresses the diaphragm 3 into a deflated mode shown by dotted lines 4. The pressure exit hole 5 is the entrance to channel 6 that carries the pressurized air out discharge hole 7 and into the top 8 of fluid reservoir 9. This fluid reservoir 9 has threads on top 8 to screw into recess 10 of upper body 1.

A discharge tube 11 carries the fluid 12 up into exit hole 13, thru channel 14, down exit tube 15, out nozzle 16 forming a spray 17, when the user releases his weight from the toilet seat TS, ambient air pressure forces return air into nozzle 16 and out tube 11 forming bubbles 18, thus equalizing the air pressure in the top 8 and expanding the diaphragm 3 to its fully expanded shape shown by line 3.

The toilet bowl rim 20 may have various heights h1. This embodiment 100 addresses this issue with a tube 15 having threads 21. Adjusting nut 22 is manually tightened to force the top 23 of nut 22 against the bottom 24 of rim 20. Thus, nut 22 can accommodate several different rims by adjusting along height h2. The nozzle 16 is preferably located at least two inches h3 above the water W.

Figure 2:
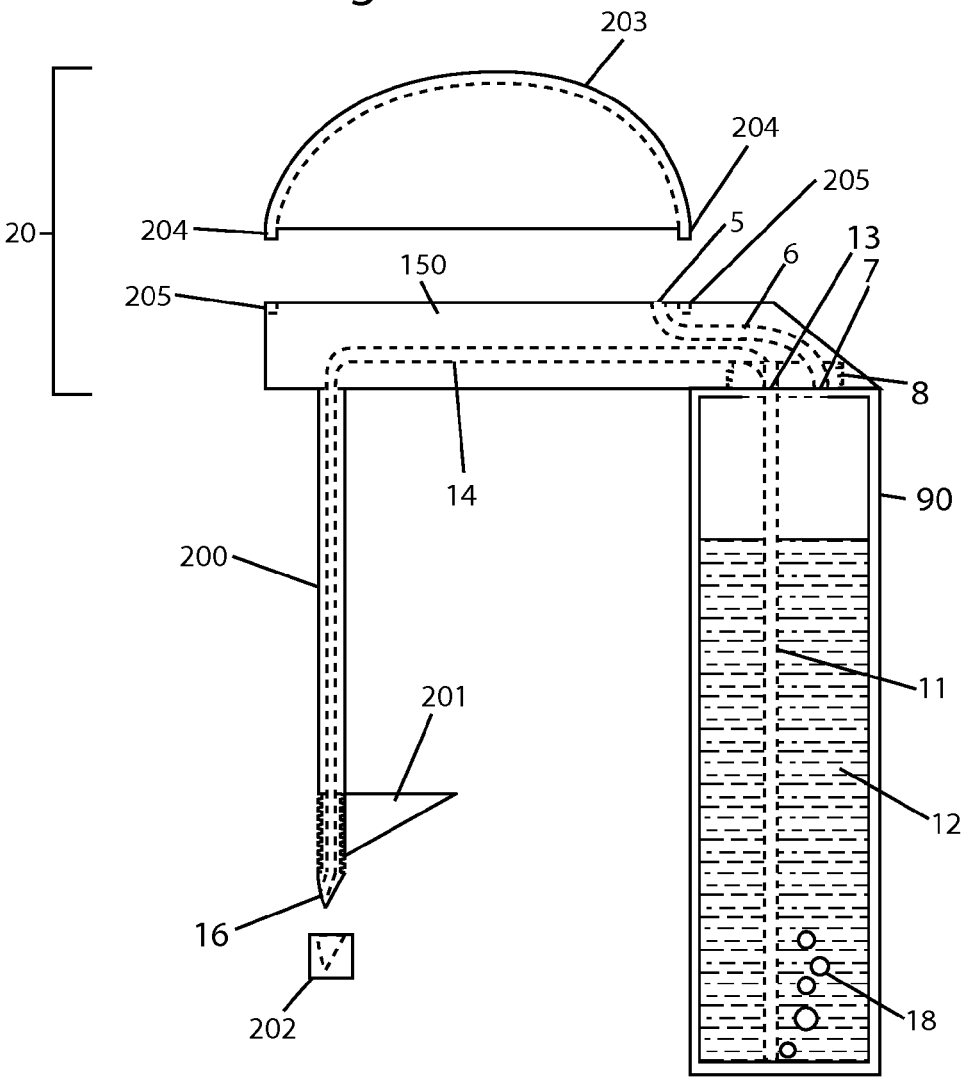
FIG. 2 is a front elevation view of a disposable deodorizer/disinfecting embodiment.

Referring next to FIG. 2 a deodorizer/disinfecting embodiment 20 is disposable. Once the fluid 12 is gone, the deodorizer/disinfecting embodiment 20 is thrown out. Otherwise it functions the same as embodiment 100. The exit tube 200 has a spring return memory to return from the install mode shown in dots to the mounted mode shown in solid lines. Thus, the clamp 201 snaps around and under the rim 20. The shipping cap 202 protects the fluid 12 from leaking out the nozzle 16 until the unit is fully mounted.

This diaphragm 203 has ridges 204 which mount into groove 205 in an air tight manner. Upper body 150 has the same internal channels 6, 14 as embodiment 100. The container 90 is integrated into the upper body 150.

Figure 3:
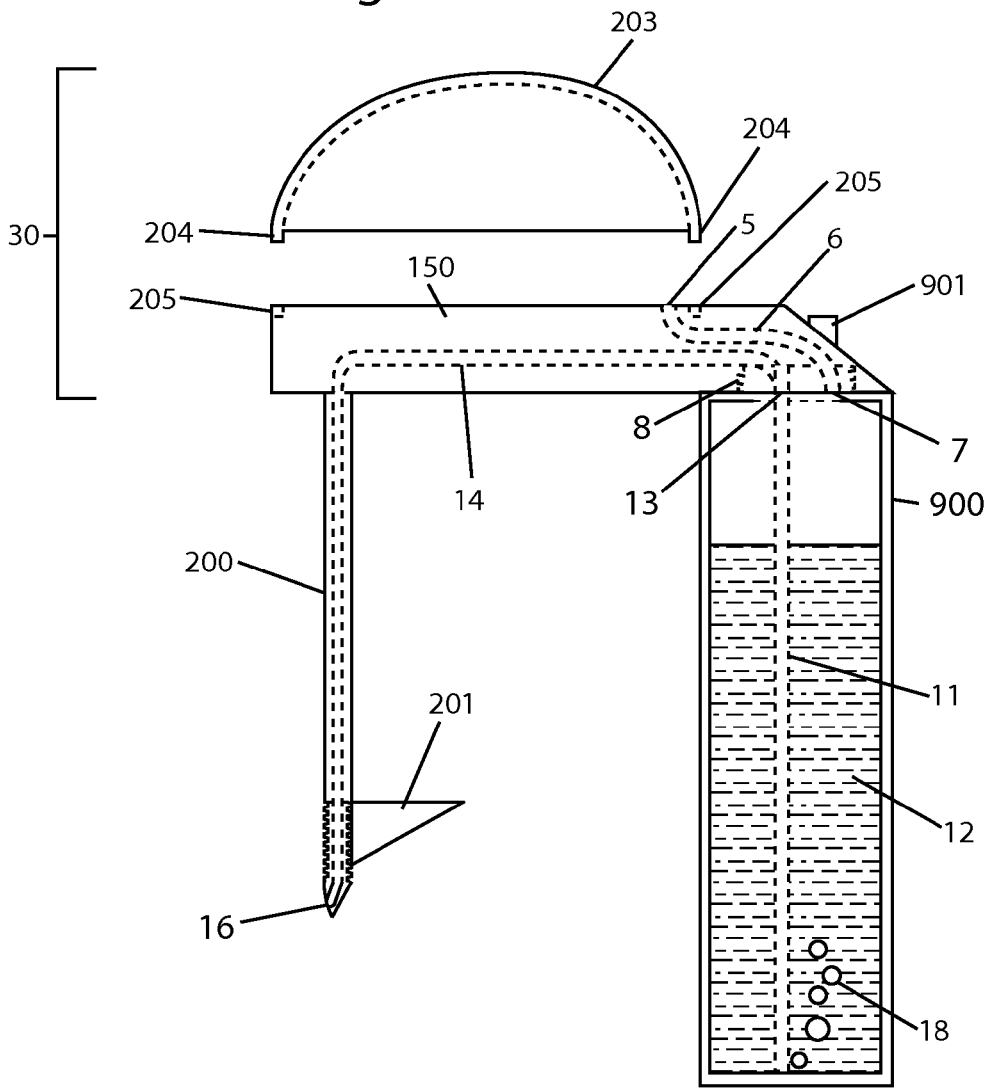
FIG. 3 is a front elevation view of a refillable deodorizer/disinfecting embodiment.

Referring next to FIG. 3 deodorizer/disinfecting embodiment 30 functions the same as embodiment 100, 20. The container 900 is integrated into the upper body 150. A filler cap 901 allows refilling the container 900.

Figure 4:
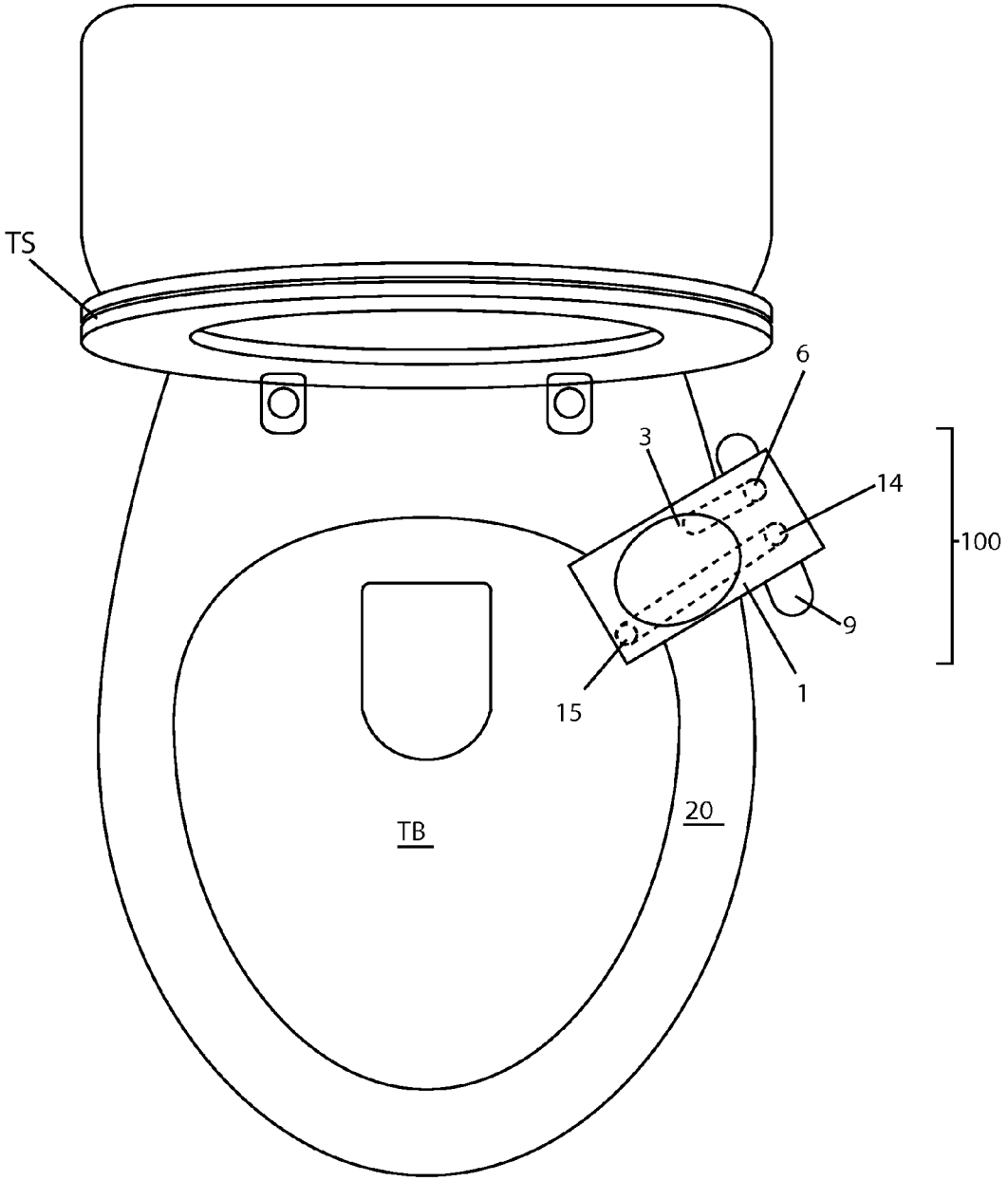
FIG. 4 is a top plan view of the mounted deodorizer/disinfecting embodiment shown in FIG. 1.

FIG. 4 shows deodorizer 100 of FIG. 1 in a top plan view. The toilet seat TS is raised.

Figure 5:
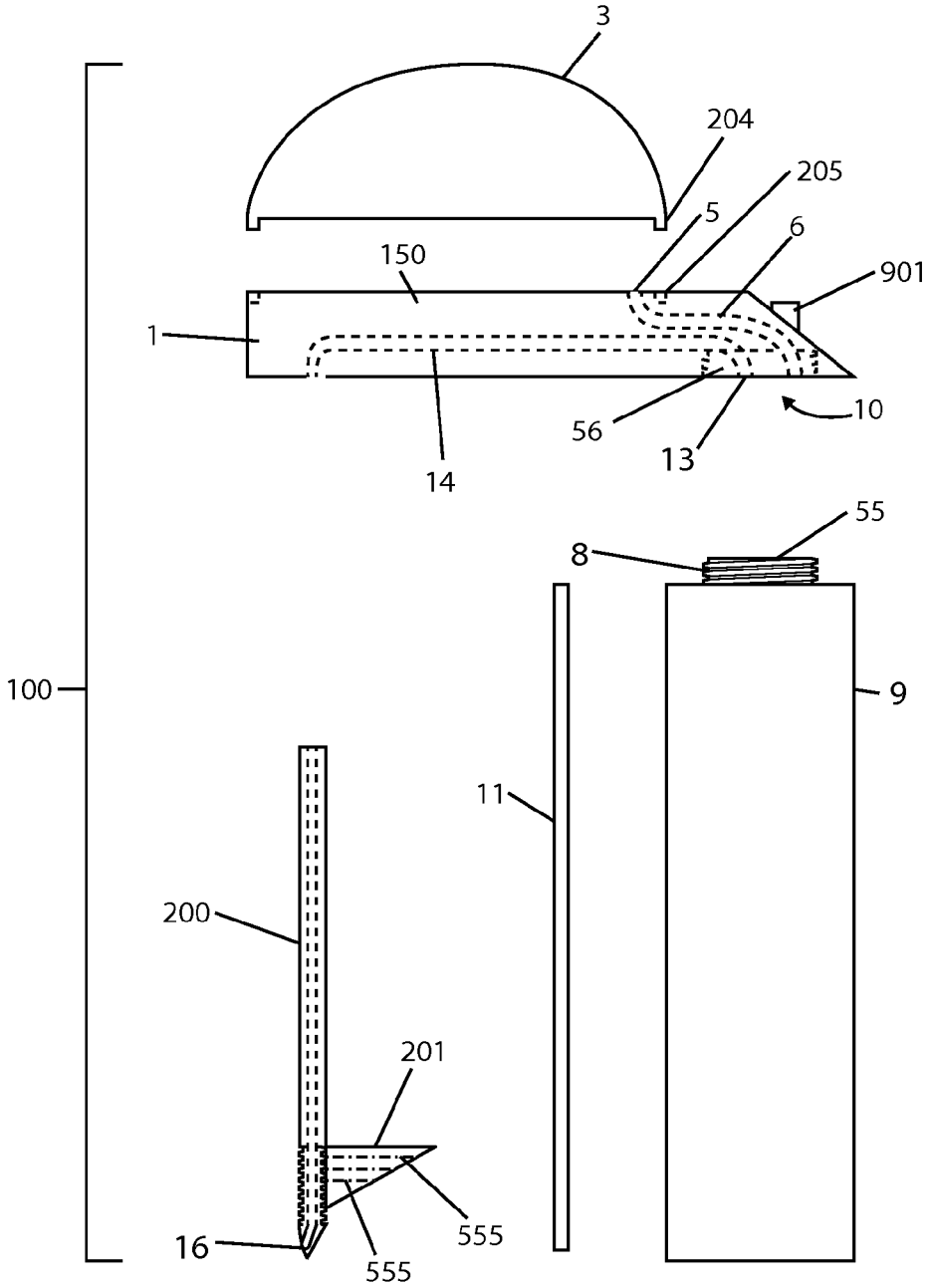
FIG. 5 is an exploded view of a refillable deodorizer/disinfecting embodiment shown in FIG. 1.

FIG. 5 shows an exploded view of deodorizer/disinfecting embodiment 100. Male threads 55 mesh with female threads 56. This embodiment uses the snap fit tube 200 instead of the threaded tube 15 shown in FIG. 1. Optional cut lines 555 allows the user using scissors to trim the size of the clamp 201 to fit the height of the rim.

While a number of exemplifying features and embodiments have been discussed above, those of skill in the art will recognize certain modifications, permutations, additions and subcombinations thereof. No limitation with respect to the specific embodiments disclosed herein is intended or should be inferred.

What is claimed is:

1. An improvement for a toilet bowl having a hinged toilet seat that rests in a closed position atop a toilet bowl rim, the improvement comprising:

an upper body that rests atop the toilet bowl rim and below the hinged toilet seat;

said upper body having a discharge tube depending therefrom to a height above a water line;

said discharge tube having a nozzle at a lower end and not having a valve;

a diaphragm connected to the upper body and having ridges extending from a bottom surface of said diaphragm which mount into a groove on the upper body in an air tight manner;

said diaphragm having a cross sectional diameter greater than a cross sectional diameter of the discharge tube;

a rim supporting means for securing the upper body to the toilet bowl rim, wherein the rim supporting means is coupled with said discharge tube and comprises a lower ledge that snap fits under the toilet bowl rim;

wherein sitting on the toilet seat causes the diaphragm to compress into a compressed mode so as to force air from the diaphragm into a valveless pressure tube that exits into a fluid reservoir attached to the upper body which then causes an increase in an ambient air pressure in the fluid reservoir so as to force a fluid in the fluid reservoir to discharge through the discharge tube out the nozzle and directed downward into the toilet bowl;

wherein no liquid enters the diaphragm at any time;

said fluid reservoir having a reservoir discharge tube that communicates with the nozzle; and wherein getting up from the toilet seat causes an ambient air pressure to equalize the pressure in the fluid reservoir and the diaphragm, thereby returning the diaphragm to an expanded mode.

2. The apparatus of claim 1, wherein the fluid reservoir further comprises a permanent connection to the upper body without any refill means, forming a disposable deodorizer/disinfecting embodiment.

3. The apparatus of claim 1, wherein the fluid reservoir further comprises a threaded top that screws into a recess in the upper body.

4. The apparatus of claim 1, wherein the fluid reservoir further comprises a refill cap that is integrated into the upper body.

5. A toilet deodorizer/disinfecting embodiment for a toilet bowl having a toilet bowl rim and a hinged toilet seat, the toilet deodorizer/disinfecting embodiment comprising:

a toilet bowl rim platform that rests atop the toilet bowl rim and below the hinged toilet seat;

a deodorant/disinfectant container suspended from the platform outside the toilet bowl and directly integrated into the platform;

a diaphragm having ridges extending from a bottom surface of said diaphragm that mount into a groove on the platform atop the platform as to compress when a downward toilet seat force is applied thereto;

said diaphragm having a cross sectional diameter greater than a cross sectional diameter of a flexible discharge tube;

wherein no liquid enters the diaphragm at any time;

a channel in the platform running from the diaphragm to the deodorant/disinfectant container;

a valveless discharge assembly running from the deodorant/disinfectant container to inside the toilet bowl;

a filler cap extending from the deodorant/disinfectant container through the platform for allowing refilling of the deodorant/disinfectant container;

a rim supporting means for securing the toilet boil rim platform to the toilet bowl rim, wherein the rim supporting means comprises the flexible discharge tube with a lower ledge that snap fits under the toilet bowl rim; and wherein the downward toilet seat force propels air from the diaphragm to the deodorant/disinfectant container, thus forcing a deodorant/disinfectant out the discharge assembly directed downward into the toilet bowl via the flexible discharge tube.

6. The deodorizer/disinfecting embodiment of claim 5, wherein the discharge assembly further comprises a tube inside the deodorant/disinfectant container coupled with the flexible discharge tube which runs through the platform and inside the toilet bowl.

7. The deodorizer/disinfecting embodiment of claim 5, wherein the deodorizer/disinfecting embodiment container further comprises a refill means allowing a user to replenish a deodorant/disinfectant.

8. A toilet deodorizer/disinfecting embodiment for a toilet bowl having a rim and a hinged seat, the toilet deodorizer/disinfecting embodiment comprising:

a toilet bowl rim platform that rests atop the rim and below the hinged seat;

said toilet bowl rim platform having a valveless discharge tube depending therefrom to a height above a water line;

a rim supporting means for securing the toilet boil rim platform to the rim;

said valveless discharge tube having a nozzle at a lower end;

a diaphragm with ridges extending from a bottom surface of said diaphragm that mount into a groove on the platform so as to compress upon a downward force on an adjacent toilet bowl seat;

said diaphragm having a cross sectional diameter greater than a cross sectional diameter of the valveless discharge tube;

wherein no liquid enters the diaphragm at any time;

a container connected to the toilet bowl rim platform; and wherein the compression of the diaphragm forces air through the toilet bowl rim platform into the container which then causes a fluid in the container to discharge out said valveless discharge tube and directed downward into the toilet bowl.

9. The deodorizer/disinfecting embodiment of claim 8, wherein the platform further comprises a channel connecting a tube in the container to the valveless discharge tube inside the toilet bowl.

10. The deodorizer/disinfecting embodiment of claim 8, wherein the platform further comprises a platform securing it to the rim.

11. The deodorizer/disinfecting embodiment of claim 8, wherein the container is non-refillable forming a disposable deodorizer/disinfecting embodiment.

12. The deodorizer/disinfecting embodiment of claim 8, wherein the container further comprises a refill means functioning to allow a replenishment of a fluid in the container.

13. The deodorizer/disinfecting embodiment of claim 12, wherein the refill means further comprises the container having a top with a removable connection to the platform.

* * * * *